United States Patent [19]

Coningsby

[11] Patent Number: 4,628,857

[45] Date of Patent: Dec. 16, 1986

[54] ROTARY SCREEN PRINTING APPARATUS

[76] Inventor: A. Robert Coningsby, 4520 NE. 25 Ave., Fort Lauderdale, Fla. 33308

[21] Appl. No.: 604,466

[22] Filed: Apr. 27, 1984

[51] Int. Cl.[4] ..... B05C 3/00; B41F 17/08; B41L 13/08

[52] U.S. Cl. ..... 118/406; 118/409; 118/414; 101/38 A; 101/120

[58] Field of Search ..... 118/406, 409, 414, 416, 118/423; 101/38 A, 38 R, 119, 120

[56] References Cited

U.S. PATENT DOCUMENTS 2,856,058 10/1958 Todd et al. ..... 101/38 R X 2,894,450 7/1959 Steinitz ..... 101/38 R X 4,436,032 3/1984 van Ouwerkerk ..... 101/120

FOREIGN PATENT DOCUMENTS 632591 11/1978 U.S.S.R. ..... 101/38 R

*Primary Examiner*—Norman Morgenstern
*Assistant Examiner*—Kenneth Jaconetty
*Attorney, Agent, or Firm*—Eugene F. Malin

[57] ABSTRACT

A screen printing drum and machine including said drum for applying a coating to various shaped substrates, more particularly, slender-like substrates, more particularly writing implements.

13 Claims, 7 Drawing Figures

ROTARY SCREEN PRINTING APPARATUS

BACKGROUND OF THE INVENTION

This invention relates generally to an improved coating apparatus for applying a coating to various shaped substrates and for the purposes of illustration, particularly a non-continuous coating to various shaped substrates, ore specifically, slender elongated articles of manufacture of substantially cylindrical in cross-section, for example, pens, wherein the non-continuous coating may be any mark, design, character or the like.

DESCRIPTION OF THE PRIOR ART

Screen printing machines including cylindrical printing stencils are known in the prior art as evidenced by U.S. Pat. No. 3,785,284 for printing on continuous webs, U.S. Pat. No. 3,665,851 for printing on curvilinearly shaped articles, e.g. drinking cups, flower pots, and U.S. Pat. No. 3,903,792.

SUMMARY OF THE INVENTION

This invention relates generally to a printing machine including at least one rotatable coating drum having a hollow interior adapted to contain a coating material, more specifically an ink composition, and a formainous pattern screen, for example a slik screen, associated with the interior or exterior surface of the drum for applying a non-continuous coating to substrates of various shapes. The machine includes a method to convey by intermittent conveyor means or continuous means constructed to convey a plurality of individual spaced substrates to a position adjacent to the coating drum and an elevating device may be used. The elevating device may be constructed for intermittently removing an individual substrate from the conveyor means and positioning the substrate into tangential contact with the peripheral surface of the drum whereby rotation of the drum produces a coating on the surface of the substrate. The conveyor means is optional as an operator may manually position a substrate on the elevating device.

It is an object of the invention to construct a machine capable of functioning safely at high mass production rates for applying a coating on the outer surface of substrates at a rate of at least 100 substrates per minute.

It is a further object of the invention to construct a machine so designed for easily manually or automatically receiving individual substrates without affecting the continuous operation of the machine.

It is a still further object of the invention to design a coating machine intermittant in operation thereby facilitating manual inspection of each of the coated substrates for facilitating discarding of imperfectly coated substrates.

It is an additional object of the invention to fabricate a machine capable of coating a plurality of individual products at a selected position of the outer surface thereof.

It is a still further object of the invention to fabricate a coating drum for applying non-uniform coatings to a substrate.

It is a still additional object of the invention to fabricate a novel printing screen for use with a rotary drum.

In accordance with these and other objects which will be apparent hereinafter, the instant invention will now be described with particular reference to the accompanying drawings.

DETAILED DESCRIPTION OF THE INVENTION

Conveyor

Figures 1, 2, 3, 4:
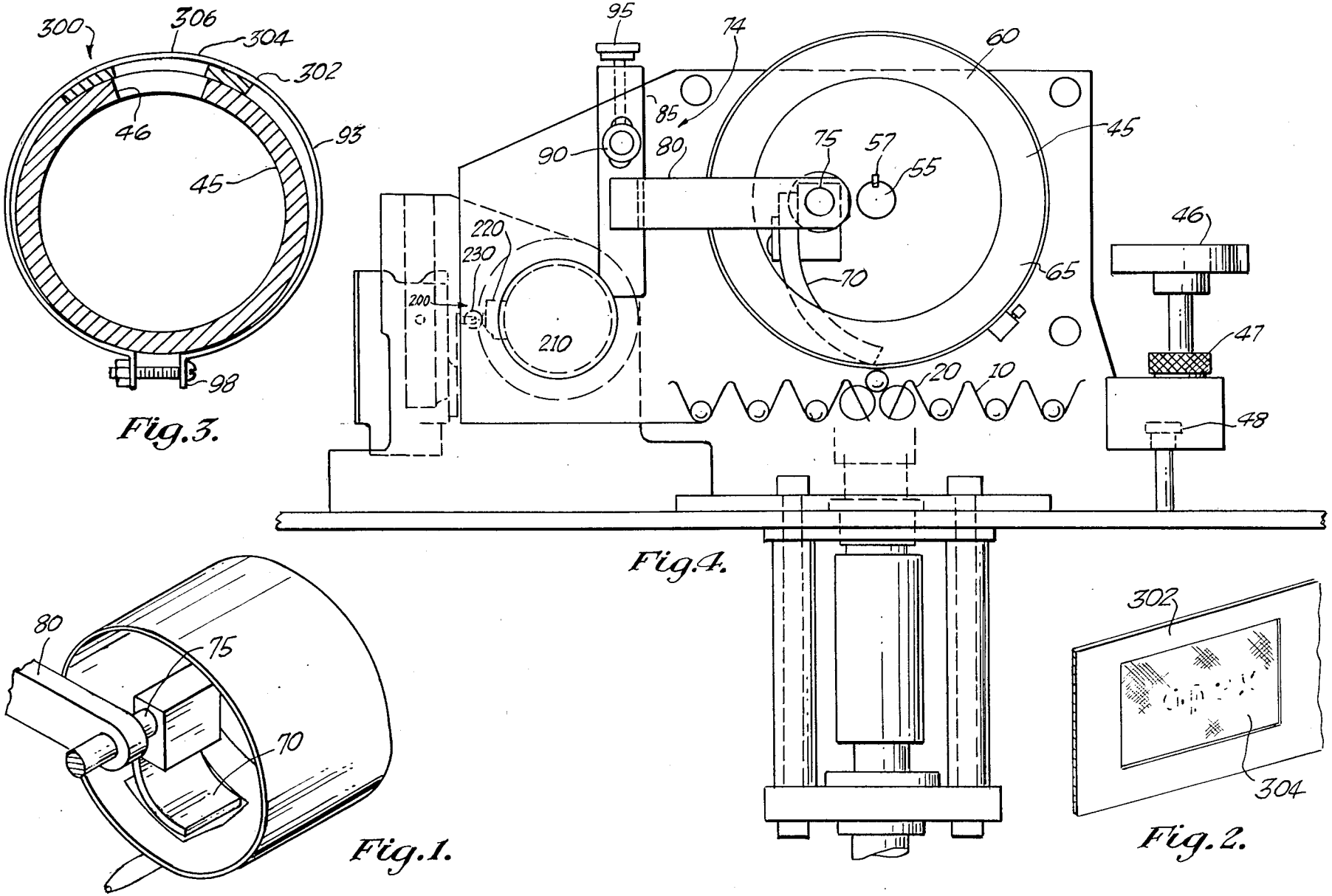
FIG. 1 is an isometric view of the cylindrical drum of the printer.
FIG. 2 is an isometric view of the screen.
FIG. 3 is a cross sectional side view of the cylindrical drum.
FIG. 4 is a side view of the cylindrical drum of the printer and converyor.

With reference to the several views of the drawing, there is depicted a rotary screen printing machine including a pair of spaced linked chain conveyors 10, each having individual triangular elements 12 secured to rods connecting each link 25 of the chain. Each triangular element 12 is contiguous to each other thereby forming saw teeth in appearance, the valleys thereof adapted to receive individual substrates either manually or mechanically placed therein. The conveyor links are rotatably supported or mounted on tracks 30. On the opposed sides of the conveyors are guide rails 35, 40 engageable with the opposite ends of the substrates for maintianing the objects in a predetermined position thereby resulting in printing of each substrate substantially or exactly on the same surface area of each object.

Cylindrical Stencil

Positioned above the conveyor, described above, is a cylindrical hollow printing drum 45 having an opening 46 for accomodating a pattern screen and having a closed face 50 end removably secured to rotatable drive means 55 for effecting rotary movement of the drum. The opposite face 60 is open, as illustrated, and includes a cylindrical flange 65 for retaining ink in the interior of the drum. The interior of the drum includes an internal screen resilient wiper blade 70 of, for example, rubber or similar material, secured to a thin flexible steel member of approximately 0.015" thick. The blade 70 can easily be adjusted in various critical angular positions relative to the inner periphery of the rotary drum, more specifically at 90', 135' and 225' to an imaginary horizontal line tangent to the periphery of the drum. The means effecting the different angular positions is generally indicated by reference numeral 74 which means 74 includes a shaft 75 on which the wiper blade is secured. Shaft 75 is mounted on L-shaped bracket 80 secured to member 85. Member 85 is adjustably mounted on a lock-screw manually movable by hand knob 95. This construction permits raising or lowering of the wiper blade and for adjusting the angular position of the squeegee and the numerical pressure of the end of the wiper blade on the internal peripheral surface of the rotary drum. The adjusted values can be read from a dial gauge (not shown). Wiper blade 70 may be adjustably rotated on shaft 75 to compensate for wearing due to occasionally sharpening of the end of the wiper by, for example, a sander, which shortens the length thereof. Eventually, however, the blade can be replaced as it is removably mounted on shaft 75 and on the steel member.

Figure 5:
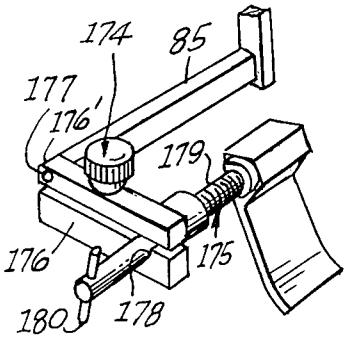
FIG. 5 is an isometric view of the wiper arm for the cylindrical drum.
Figure 6:
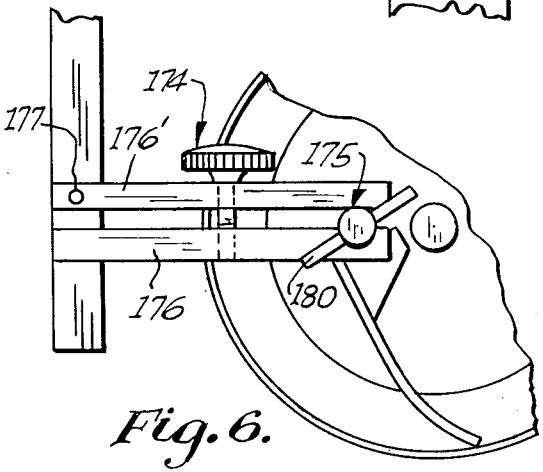
FIG. 6 is a side view of the wiper arm for the cylindrical drum.

FIGS. 5 and 6 illustrates a further embodiment for mounting shaft 75 by utilizing a clamp, generally indicated by reference numeral 174, in lieu of using fixed bracket 80. Clamp 174 includes a pair of members 174, 176, movable relative to each other, element 175 being pivotally mounted to aforementioned member 85 at 177 and element 176 also being fixed permanently to member 85. Pivoted element 175 includes an internally threaded aperture 178 threadedly receiving and externally threaded rod 179 having a handle 180 at one end, the opposite end thereof being engagable with a recess 181 in member 176 which prevents lateral movement of the rod 179 of member 176 includes a second recess 182 accommodating shaft 75. Rotation of rod 179 affects movement of member 175 relative to member 176 to engage and clamp shaft 75 thereby maintaining shaft 75 in its operative position.

Print drum 45 is removably mounted in the manner of a cantilevar on drive shaft 55 via keyway 57 for rapid interchange of various drums including different colored compositions as well as permitting cleaning thereof. The position of the print drum can be adjusted in its relationship to a substrate by a pair of elevating screws 46 (only one being illustrated) which includes a lock nut 47 and a screw clamp 48 functional connected to the frame supporting the print drum.

Illustrated in FIGS. 2 and 3, is a detailed view of a printing screen generally indicated by numeral 300 for association with rotary drum 45. The printing screen comprises a flexible laminate including a thin flexible plastic gasket 302 and a printing screen 304 attached thereto by glue or tape. Gasket 302 is about 1/16" thick and could contain a plurality of magnetic particles distributed throughout the plastic for connection purposes instead of tape and clamp and further has an opening 306 of about the same dimensions as opening 46 in drum 45. Printing screen 304 is formed by conventional photographic emulsion techniques with use of high energy radiation, e.g. ion beam. This technique permits fabrication of an extremely thin printing laminate which facilitates passage of coating material through the individual foramen of the screen with formation of distinct non-continuous coatings on a substrate without smearing of the coatings. The laminate can thus be magnetically maintained on the periphery of the drum. Clamping of the silk screen to the drum is accomplished by a resilient flexible band 90 encircling the drum which includes an opening 46 of dimensions about that of the silk screen. Band 93 includes complementary engageable means 98 similar in construction to a hose clamp, for connecting the opposite ends of the band for fixedly securing the band to the drum.

The relationship of the size screen and rotational speed of the drum for applying coatings of various thicknesses is set forth in the Table below:

| Screen No. | Speed R.P.M. | Coating Thickness |
|---|---|---|
| 390 | 100 | light |
| 335 | 100 | medium |
| 245 | 100 | heavy |
| 240 | 130 | heavy |

Elevator

Figure 7:
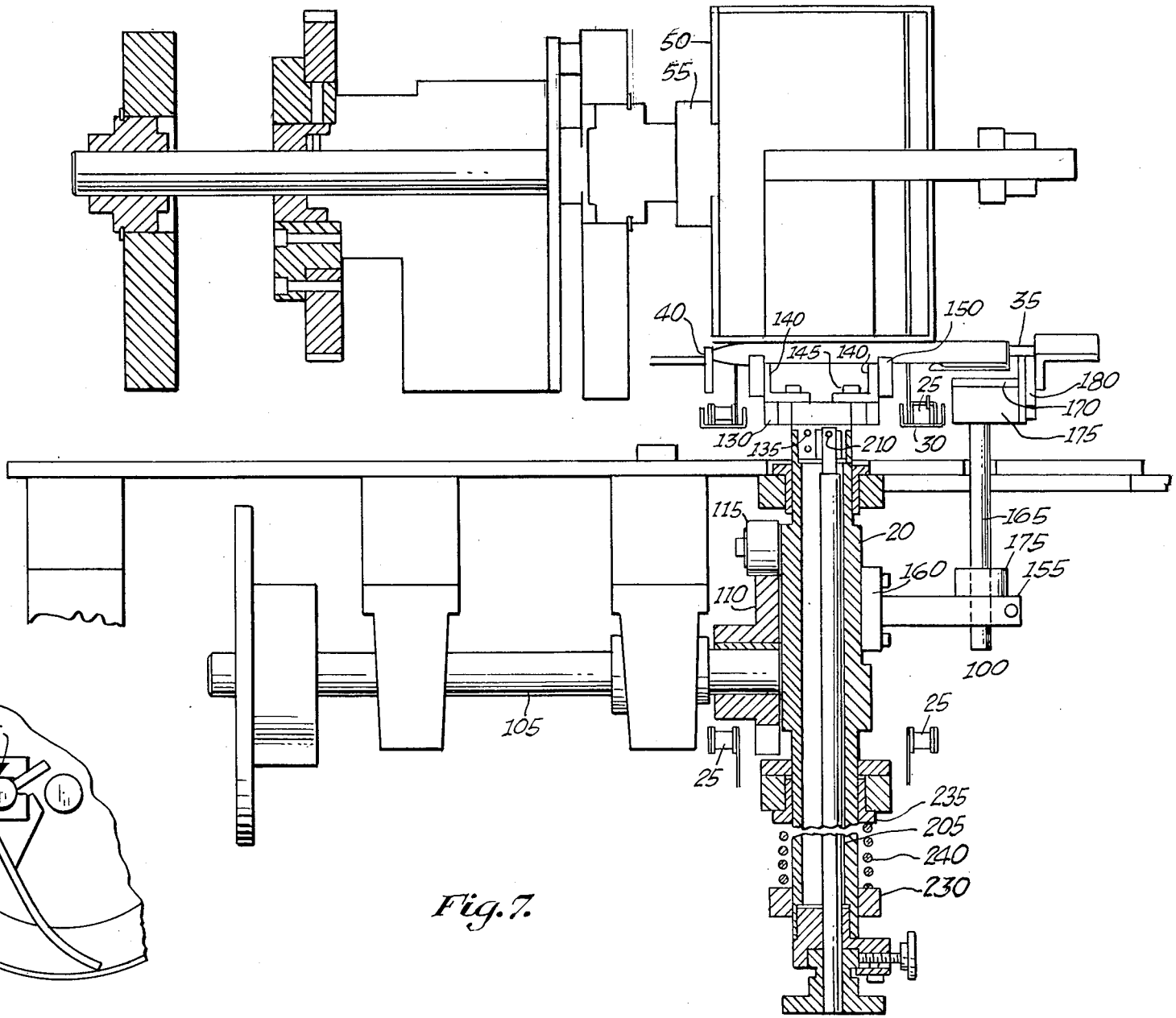
FIG. 7 is a front view of the cylindrical drum of the printer and conveyor.

The object to be printed is lifted in position by an elevating mechanism generally designated by numeral 100 and illustrated in detail in FIG. 7. The elevating mechanism includes a camshaft 105 having fixed thereto an elevating cam 110 secured thereto by a conventional means, e.g. a set screw, the cam being of conventional design. A cam follower 115 engages the peripheral surface of the cam and is freely mounted for rotation on shaft 120 thereby enabling raising and lowering of said shaft. A substrate fixture 125 is mounted at the upper end of shaft 120 and is positioned between the pair of link chain conveyors. The fixture 125 includes a T-shaped member 130 rockably supported to the upper end of shaft 120 by a pivot pin 135. Secured to member 130 are a pair of L-shaped brackets 140 via bolts or like fastening means 145 to each of which are mounted a pair of spaced rollers 150 freely mounted on a pair of shafts secured to bracket 140. The spacing between the rollers is of a distance sufficient to support a substate therebetween.

Another embodiment of the elevating mechanism is shown in Figure and includes a pair of rollers 150', similar to rollers 150, mounted in a support 152' biased by tension spring 154' into contact with the rotary drum. The tension of the spring may be adjusted by an adjusting feature.

Mounted laterally of shaft 120 is a member 155 secured to the shaft via bolt and bracket 160. Member 155 includes an opening for receiving shaft 165 including a resilient cushioning element 170. A magnet 170 is mounted on a support 175 fixed to end of shaft 165, the magnet functioning to rotate a non-magnetic substrate by the magnetic attraction of a piece of metal mounted on the non-magnetic substrate. The elements 120–175 constitute a substrate outboard support. The side of support 175 includes adding support means 180 for the depressible part of the substrate which is of known construction.

The lower end of shaft 120 includes means generally indicated by numeral 200 for adjusting the operating position of rollers 150, the means 200 comprises pivot rod 205 pivotally mounted to member 130 via pivot pin 210 which is adjusted by adjusting knob 220 which is locked in position by lock screw 225. Also, secured to shaft 120 are means 230, 235 retaining a spring 240 functioning to return shaft 120 to its inoperative position when cam follower 115 returns to the dwell position of cam 110. Element 235 includes a shock absorbing washer 240.

Drive Mechanism

The drive means for synchonous movement of conveyor 10, print drum 45, elevator mechanism 100 is generally indicated by reference numeral 200 which includes drive shaft 210. Fixed to shaft 210 is a limit siwtch cam 220 which is cyclically engaged by limit switch 230. A D.C. motor is used to furnish the power through a speed reducer and torque limits. This gives an indefinite speed from 0 to 100 pens per minute.

Operation of Machine

Subtrates, more specifically pens, are placed on conveyor 10, and are moved to position A at which time the substrate is lifted by the elevating mechanism 100 into engagement with a continuously rotating printing drum 45 which may be adjusted to attain the optimum radial position of thereof. The wiper blade may be positioned that one corner of the blade is tangent to the pen in its print position in order to obtain the optimum quality of printing on the substrate.

It will be apparent that various modifications may be made to the specific structural embodiments discussed above without departing from the scope of the invention.

It should be noted that the object receiving the print or surface can be circular as shown or flat or conical or other shapes. Further the drum may be cylindrical as shown or may be conical or oval or any other such shape.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A device for dispensing materials in creating patterns useful in printing, comprising:

a drum connected to said device and constructed for rotation about an axis having a hollow interior adapted to retain a supply of the material, said drum having an outer drum working surface;

said drum having an aperture communicating with said hollow interior of said drum;

a pattern making screen mounted across said aperture and substantially in the extended phantom surface of the external peripheral surface of said drum across said aperture and thereby being positioned in a working position in relationship to said drum working surface for creating the patterns, the external peripheral surface of said drum being imperforate except for said aperture;

connecting means for removably connecting said pattern making screen across said aperture in said extended phantom surface and to said drum;

a means for forcing said material through said pattern making screen, said means for forcing said material being positioned within said interior of said drum; and said hollow interior constructed for maintaining a puddle of the material in contact with said means for forcing said material on the side of the direction of rotation.

2. A device as set forth in claim 1, wherein:

said drum includes an axle connectable to a drive means for rotation of said drum;

said drum having an outer working surface shaped generally similar to the item to be printed;

said hollow interior constructed and arranged to supply the pattern making material to said screen and said means for forcing said material through said pattern making screen;

a means for forcing said material is a wiper; and a means for supporting said wiper connected between said wiper and said device.

3. A coating applicator comprising:

(a) a rotatable hollow drum adapted to contain a coating material and including an aperture in the peripheral surface thereof, the external peripheral surface of said drum being imperforate except for said aperture;

(b) a formainous screen associated with said drum and mounted across said aperture substantially in the extended phantom surface of the external peripheral surface of said drum across said aperture and circumscribing said aperture;

(c) a first means for removably maintaining said screen operatively associated substantially in the extended phantom surface with said drum;

(d) a second means disposed within the interior of said drum and operatively associated with the interior surface of said screen; and (e) means for supporting said second means in such manner that relative rotational movement of said drum and said second means functions to cause coating material to pass through the foramen of said screen;

(f) a mounted axle, said drum mounted on said axle for rotating said drum about an axis; and (g) means mounted only at one side of said drum for effecting rotary motion of said drum, the opposite side of said drum being free and unobstructed to thereby constitute a cantilvered drum.

4. A coating apparatus as recited in claim 3 wherein said screen is so constructed that the coating material non-uniformly passes through the foramen of said screen.

5. A coating apparatus as recited in claim 4 wherein the second means is so constructed to engage the interior surface of the drum for forming a puddle of the coating material in contact therewith and with the interior surface of said drum.

6. A coating applicator as recited in claim 3 wherein said opposite side of said drum has an opening and wherein said second means is a wiper, and means extending within said opening in said opposite side of said drum for supporting said wiper.

7. A coating applicator as recited in claim 3 wherein said applicator is so constructed that frictional contact of said drum with a substrate to be coated constitutes the sole means for effecting relative movement of said drum and the substrate.

8. A coating applicator as recited in claim 3 wherein said means (c) is so constructed for permitting quick release of said screen from the peripheral surface of said drum.

9. A coating applicator as recited in claim 3 wherein said second means (d) is a wiper blade and means for adjusting the position of said wiper blade relative to the inner periphery of said drum, wherein said adjusting means comprises an arm having one end connected to the end of the blade opposite the free end thereof contacting the interior of said drum and means associated with the opposite end of said arm for changing the angular position of said wiper blade and/or the pressure of the free end of said wiper blade in contact with the internal peripheral surface of said drum to thereby control the rate of discharge of the coating material through the foramina of said screen with consequent control of the thickness of the coating on the substrate.

10. A device as recited in claim 1 wherein the screen is mounted across said aperture in interfacial relationship with the external peripheral surface of said drum.

11. A coating applicator as recited in claim 3 wherein the screen is in interfacial relationship with the external peripheral surface of said drum.

12. A coating apparatus as recited in claim 8 wherein said means (c) is the hose-clamp type.

13. A coating apparatus as recited in claim 1 wherein said screen comprises a laminate including a thin plastic gasket and a printing screen, said gasket including magnetic particles distributed in said plastic and wherein said drum is metallic whereby said laminate is magnetically secured to said drum thereby providing a quick release of said screen.

* * * * *